US009920262B1

(12) United States Patent
Wistrom et al.

(10) Patent No.: US 9,920,262 B1
(45) Date of Patent: Mar. 20, 2018

(54) METHODS OF SEPARATION OF PYROLYSIS OILS

(71) Applicant: RJ LEE GROUP, INC., Monroeville, PA (US)

(72) Inventors: Jonathan Lyle Wistrom, Maryville, MO (US); Earl Richard Beaver, Chesterfield, MO (US); Skyler Linn Wistrom, Maryville, MO (US); Alan M. Levine, Monroeville, PA (US); Richard J. Lee, Murrysville, PA (US)

(73) Assignee: RJ LEE GROUP, INC., Monroeville, PA (US)

( * ) Notice: Subject to any disclaimer, the term of this patent is extended or adjusted under 35 U.S.C. 154(b) by 0 days.

(21) Appl. No.: 15/358,201

(22) Filed: Nov. 22, 2016

(51) Int. Cl.
*C10G 53/14* (2006.01)

(52) U.S. Cl.
CPC ..... *C10G 53/14* (2013.01); *C10G 2400/30* (2013.01)

(58) Field of Classification Search
CPC ..... C10G 53/14
USPC ..... 568/61
See application file for complete search history.

(56) References Cited

U.S. PATENT DOCUMENTS

| | | | |
|---|---|---|---|
| 3,702,292 | A | 11/1972 | Burich |
| 4,983,278 | A | 1/1991 | Cha et al. |
| 5,779,883 | A | 7/1998 | Hearn et al. |
| 6,444,118 | B1 | 9/2002 | Podrebarac et al. |
| 6,673,236 | B2 | 1/2004 | Stanciulescu et al. |
| 6,833,485 | B2 | 12/2004 | Nichols et al. |
| 6,835,861 | B2 | 12/2004 | Nichols et al. |
| 7,341,646 | B2 | 3/2008 | Nichols et al. |
| 8,043,495 | B2 | 10/2011 | Podrebarac |
| 8,293,952 | B2 | 10/2012 | Levin |
| 2014/0305786 | A1 | 10/2014 | Beaver et al. |

OTHER PUBLICATIONS

Maria Stanciulescu, Limonene ethers from tire pyrolysis oil Part 1: Batch experiments, Journal of Analytical and Applied Pyrolysis, 2006, pp. 217-225, 75, Elsevier, Canada.
Maria Stanciulescu, Limonene ethers from tire pyrolysis oil Part 2: Continuous flow experiments, Journal of Analytical and Applied Pyrolysis, 2006, pp. 76-84, 78, Elsevier, Canada.
Roy, et al., Production of dl-limonene by vacuum pyrolysis of used tires, Journal of Analytical and Applied Pyrolysis, 2001, pp. 91-107.

*Primary Examiner* — Deborah D Carr
(74) *Attorney, Agent, or Firm* — Eckert Seamans Cherin & Mellott, LLC; Arnold B. Silverman

(57) ABSTRACT

Methods for processing pyrolysis oil employs two or more of the following steps: A first separation creates (a) a lighter fraction and heavier fraction, (b) subjecting the lighter fraction to distillation and (c) subjecting the heavy fraction to removal of at least one of sulfur and nitrogen.

28 Claims, 3 Drawing Sheets

METHODS OF SEPARATION OF PYROLYSIS OILS

BACKGROUND OF THE INVENTION

1. Field of the Invention

The present invention relates to methods of extracting an enhanced feedstock for distillation from pyrolysis oil and, more specifically, it relates to methods for performing an initial separation which establishes a lighter fraction and a heavier fraction. The lighter fraction is subjected to plate distillation and the heavier fraction is subjected to the removal of sulfur and nitrogen compounds therefrom to facilitate the use of the heavier fraction as heavy fuel oil. A preferred starting material is obtained from vehicular tires.

2. Description of the Prior Art

It has been known to subject rubber, such as scrap tires, to pyrolysis with the process producing a solid fraction such as carbon black, a liquid hydrocarbon and a gas. The liquid hydrocarbon may have potential as a fuel oil. See U.S. Pat. Nos. 6,833,485; 6,835,861; and 7,341,646.

U.S. Pat. No. 6,673,236 discloses the reduction of sulfur in petroleum middle distillates through catalytic oxidation in which vanadium is present. There is no disclosure of pyrolysis oil. Ethanol is present and is said to have a portion oxidized to form peracetic acid which is said to contribute to further oxidation. The final separation is specific for the alcohol MeOH and EtOH.

U.S. Pat. No. 8,043,495 discloses sulfur reduction in a hydrocarbon stream employing a catalytic distillation reactor and a hydrodesulfurization catalyst. A low-mercaptan product is said to be produced.

U.S. Pat. No. 4,983,278 discloses a two temperature pyrolysis method which employs oil recycling. It discloses creation of a light oil, heavy oil and solid residue in a two temperature process.

U.S. Pat. No. 3,702,292 discloses distillation of a crude oil into a number of fractions followed by catalytically cracking a gas oil fraction to form propane and other fractions.

U.S. Pat. No. 8,293,952 discloses a pyrolysis process where a basic metal oxide catalyst is employed and a resultant pyrolysis product is said to be high in alcohol content.

U.S. Pat. No. 6,444,118 discloses catalytic distillation technologies employed in sulfur reduction in naphtha streams. It employs a distillation column reactor to process petroleum streams containing organic sulfur and hydrogen which are contacted in the presence of hydrodesulfurization catalytic distillation structure.

It has generally been recognized that tire-derived pyrolysis oil contains valuable terpene and other unsaturates as well as mercaptans and other sulfur containing compounds. Attempts to isolate fractions containing these compounds in a commercially viable fraction have not been successful.

Pyrolysis-derived oil, in particular that derived from pyrolysis of a polymer, is a complex mixture of saturated and unsaturated hydrocarbons and includes polar compounds containing sulfur, nitrogen, and oxygen. Depending upon the polymer, it could contain halogenated compounds as well. These oils are often sold as a low-grade fuel at a low return. Due to a moderate sulfur content of these oils, they are generally used in less environmentally sensitive operations or, those that scrub their emission to remove sulfur. The petrochemical industry generally uses hydrodesulfurization using a metal catalyst and hydrogen gas to convert organosulfur compounds to hydrogen sulfide plus saturated hydrocarbon by the following reaction. $RSH+H_2 \rightarrow R+H_2S$ where R is a hydrocarbon. The hydrogen sulfide is converted to elemental sulfur or sulfate. This process requires the use of hydrogen gas under pressure and is typically economically practical only on a large scale.

It is generally recognized that tire-derived pyrolysis oil contains valuable terpene and other unsaturates as well as mercaptans and other sulfur-containing compounds. However, attempts to isolate fractions containing these compounds have not yielded commercially valuable fractions. This is due to many issues from the complex nature of tire-derived pyrolysis oil. Attempts at direct distillation of the pyrolysis oils yield complex mixtures of compounds and distillate instability during distillation. Temperature variation in the heating vessel causes the fractions to have broad boiling point ranges. More significantly, pyrolysis oils yield reactive compound that, at high wall temperatures required by standard distillation, will react or crack during distillation causing foaming and difficulty in controlling temperature, pressure, and separation. M. Stanciulescu and M. Ikura (Limonene Ethers from Tire Pyrolysis Oil Part 1: Batch Experiments., J. Anal. Applies Pyrolysis 75, pp 217-225, 2006.) noted that limonene co-eluted with naphtha and proposed to react the limonene with methanol to shift its boiling point in order to separate it from the oil. They would then have to back react the ester to recover limonene. Roy, et. al. (Production of dl-limonene by vacuum pyrolysis of used tires, Journal of Analytical and Applied Pyrolysis 57 pp, 91-107, 2001.) found that pyrolytic breakdown products of limonene plus thiophene and other sulfur compounds co-eluted with limonene and made clean separation of limonene difficult. This again, shows the difficulty in isolating limonene from pyrolysis oil.

There remains, therefore, a real and substantial need for methods of treating pyrolysis oil to effect separation of commercially desirable fractions from fractions suitable for use as fuel oil.

SUMMARY OF THE INVENTION

The present invention has provided a solution to the shortcomings of the hereinbefore discussed prior art by providing effective methods for a processing pyrolysis vapor to effect separation of commercially desired fractions from heavier fractions suitable for use as fuel oil. More specifically, in a preferred embodiment, a first phase separation of the pyrolysis gas results in a lighter fraction and a heavier fraction. This is followed by a second phase subjecting the lighter fraction to plate distillation to separate the commercially desirable products. The heavier fraction in a third phase is subjected to oxidative desulfurization with nitrogen containing organic compounds being removed with the desufurization process are employed to produce an effective fuel oil product. A preferred initial separation of the pyrolysis oil involves thin film distillation as this effectively and economically produces the desired first stage of separation. Certain preferred parameters with respect to the plate distillation process as preferred features are disclosed.

Depending upon the specific objectives of a particular use, combinations of the three phase method employing less than all three, may be advantageously employed.

In another embodiment, the thin film distillation is followed by the compound distillation without employing the desulfurization step.

In a further embodiment, the product of the thin film distillation is subjected to the oxidative catalytic desulfurization without employing the plate distillation process.

It is an object of the present invention to provide efficient and effective methods for separating pyrolysis oil into (a) fractions which have enhanced marketability and (b) a utilitarian fraction which provides a marketable fuel product.

It is a further object of the present invention to provide such methods which can be employed on a small and moderate scale as well as on a very large scale.

It is a further object of the present invention to make efficient use of thin film distillation.

It is an object of the present invention to effect separation of pyrolysis oil into a commercially viable enhanced feedstock for distillation and to provide a heavy fraction with a more acceptable flashpoint and fewer highly volatile compounds than the pyrolysis oil taken as a whole.

It is a further object of present invention through thin film distillation to expose the pyrolysis oil to a substantially lower temperature and for a shorter time than required for bulk distillation and achieve the desired separation without encountering undesired cracking and coking reactions.

A further object of the invention to provide methods of catalytic oxidative reduction of sulfur content and nitrogen content.

These and other objects of the invention will be more fully understood from the following detailed description of the invention on reference to the illustrations appended hereto.

DESCRIPTION OF THE PREFERRED EMBODIMENTS

Referring again to FIG. 1, Phase I, provides an initial separation of the pyrolysis oil, preferably through thin film distillation.

It is an initial separation which produces (a) a light fraction which contains most of the commercially valuable compounds including, but not limited to, terpenes, mercaptans and cyclohexenes and (b) a heavy fraction.

In Phase II, the lighter fraction received from Phase I employs a plate distillation system with a split reflux that recovers from the light fraction the commercially valuable components of the pyrolysis oil.

Phase III receives the fuel oil fraction and subjects it to catalytic oxidation to reduce the sulfur and nitrogen contained in the heavy phase. A preferred catalyst employs molybdenum and aluminum with the preferred catalyst being a mixture of molybdenum trioxide and aluminum oxide. It is preferred to have the mixture on a weight to weight basis having a ratio between 0.5:1 weight to about 1:0.5 weight with the most preferring ratio of molybdenum trioxide to aluminum oxide being about 1:1.

Figure 2:
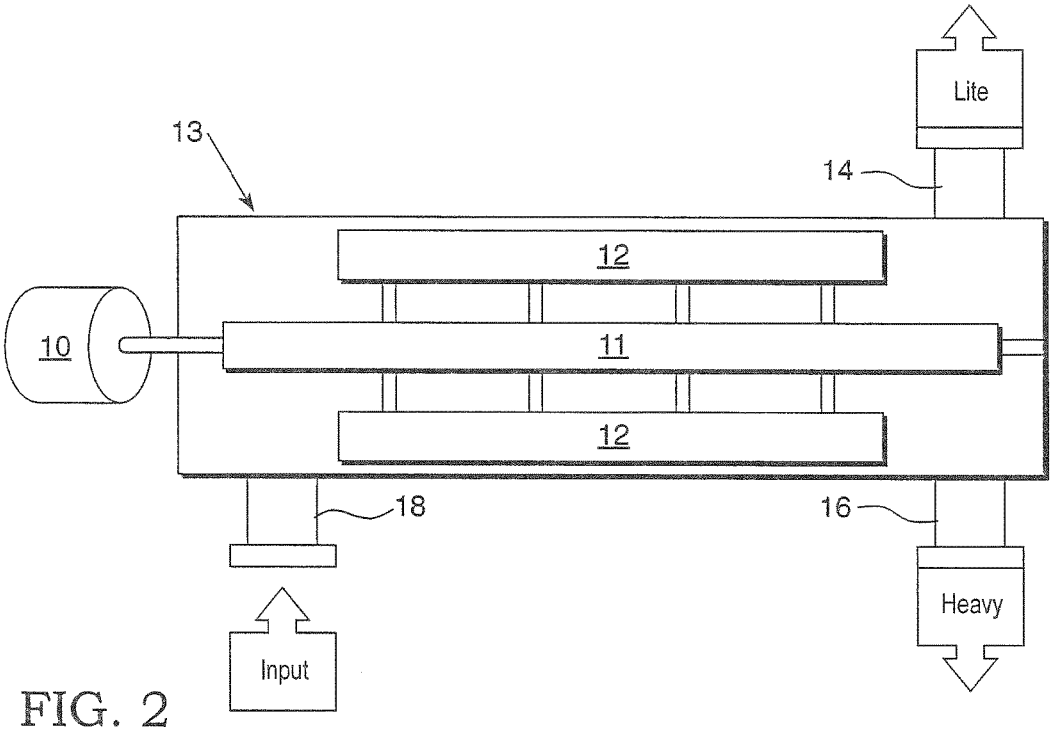
FIG. 2 is a schematic illustration of apparatus employable with the Phase I thin film distillation.

Referring to FIG. 2, there is shown a preferred thin film distillation process and equipment useable with the same. A motor 10 is operatively associated with and drives a wiper rotary shaft agitator 11 which has fixedly secured thereto for rotation therewith a plurality of wipers 12. A surrounding heated jacket 13 is provided. Pyrolysis oil to be processed through the method is introduced through feed input tube 18 and the agitator 11 is rotated by a motor 10 to create a thin layer of oil on the interior surface of the reactor jacket 13. The speed of the drive is established so as to not create pooling channels along the interior surface wall of the reactor 13. The system is preferably operated at about 100 to 300 torr vacuum and, most preferably, at about 145 to 155 torr for the entire run while maintaining a reactor wall temperature of about 125° C. to 145° C. and, most preferably, about 130° C. to 140° C. Two fractions are created by this process. A light fraction exits through the light outlet 14. It is the distillate fraction that is enriched in essential oils and high volatile solvent chemical to form an enhanced feedstock for further processing. The heavy fraction exits through the heavy or bottom outlet 16 and is a stable fuel oil that is potentially valuable as heating and engine fuel stock. Any thin film or wipe evaporator configuration horizontal, or vertical and concurrent flow or countercurrent flow can be employed so long as the operation is used within the temperature and pressure ranges disclosed herein. The system is preferably operated at about 100 to 300 torr vacuum and more preferably at about 135 to 155 torr for the complete run while maintaining the interior wall of the reactor jacket 13 at about 125° C. to 145° C. and, more preferably, about 130° C. to 140° C.

An advantage of thin film distillation is that the thin film of oil heats quickly and evenly and breaks the interactions between the lighter and heavier compounds without cracking or coking reactions. This is why it is preferable to use a thin film distillation to make an enhanced feedstock without destroying the integrity of the heavy or light fraction of the oil.

Figure 3:
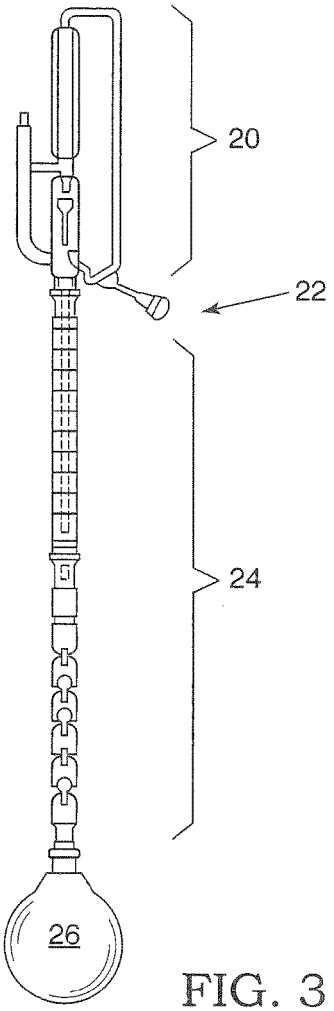
FIG. 3 is a schematic illustration of the apparatus employable with the Phase II distillation system.

FIG. 3 shows an apparatus usable in the Phase II distillation system for distilling the lighter fraction emerging from Phase I. FIG. 3 shows reflux control head 20 which is operatively associated with the purified distillation fractions 22 and the distillation column 24. The column, preferably, has about 10 to 30 plates and, most preferably, about 15 to 20 plates. A feed bomb 26 is employed to heat the feed material. The evaporated feed enters the multi-plate column 24 with reflux control head 20 being preferably set at about a 2:1 to 10:1 ratio and most preferably, about 5:1 to 7:1 ratio. The distillation output is collected at outlet 22.

The separated commercially valuable component fraction typically consists of about 20 to 35 weight percent of the starting pyrolysis oil with the heavy fraction consisting of about 65 to 80 weight percent of the starting pyrolysis oil.

EXAMPLE

An example of Phase II will be considered. The feed material is the lighter fraction emerging from the Phase I thin film distillation.

The system is set initially to a range of 100-400 torr with a preferred setting of about 300 torr vacuum for collection of lower fraction which is collected from approximately 20° C. to 25° C. until the distillate reaches about 134° C. and 145° C., more preferred between 139° C. and 141° C. This lower fraction can be split into several temperature cuts. An example is as shown in TABLE 1.

TABLE 1

| Temp/ pressure | Temp (° C.) | Preferred Temp (° C.) | vacuum (torr) |
|---|---|---|---|
| cut 1 | Start-115° C. | start-105.8 | 300 |
| cut 2 | 106° C.-138° C. | | 300 |
| cut 3 | 139° C.-141° C. | | 300 |

The described cuts consist on several low boiling point highly volatile solvent chemicals. These include, but are not limited to, Xylene, Toluene, and Styrene making the individual, as well as the combined solution(s), extremely valuable in the industrial market.

After collection of fractions up to 141° C. at the preferred vacuum of 300 torr, the temperature is allowed to cool to room temperature and the vacuum is increased to a range of 100-300 torr with a preferred setting of 150 torr. A cut is made at 115° C.-125° C., more preferably between 1.19° C. and 123° C. at the preferred vacuum and is either added to the prior lower cut or kept separate as a lower volatile solvent solution. The next split is collected by continuing to apply heat until 124° C. to 127° C., more preferably between 125° C. to 126° C. At the preferred vacuum, this cut is going to contain the bulk of the limonene and p-Cymene and is collected as a single fraction and is kept separate. After that, a single fraction up to 132° C. is collected as a clearing cut to ensure that all of the high value material is extracted in this process. A generalized description at preferred conditions, for the splits are as shown in TABLE 2.

TABLE 2

| Temp/ pressure | Temp (° C.) | Preferred Temp (° C.) | vacuum (torr) |
|---|---|---|---|
| cut 4 | 118-128 | 20-121.2 | 150 |
| cut 5 | | 121.3-122 | 150 |
| cut 6 | | 122-131.5 | 150 |

The resulting fraction can be combined or maintained separately to provide fractions containing high volatile solvent chemicals and/or essential oils at various purities.

Figure 4:
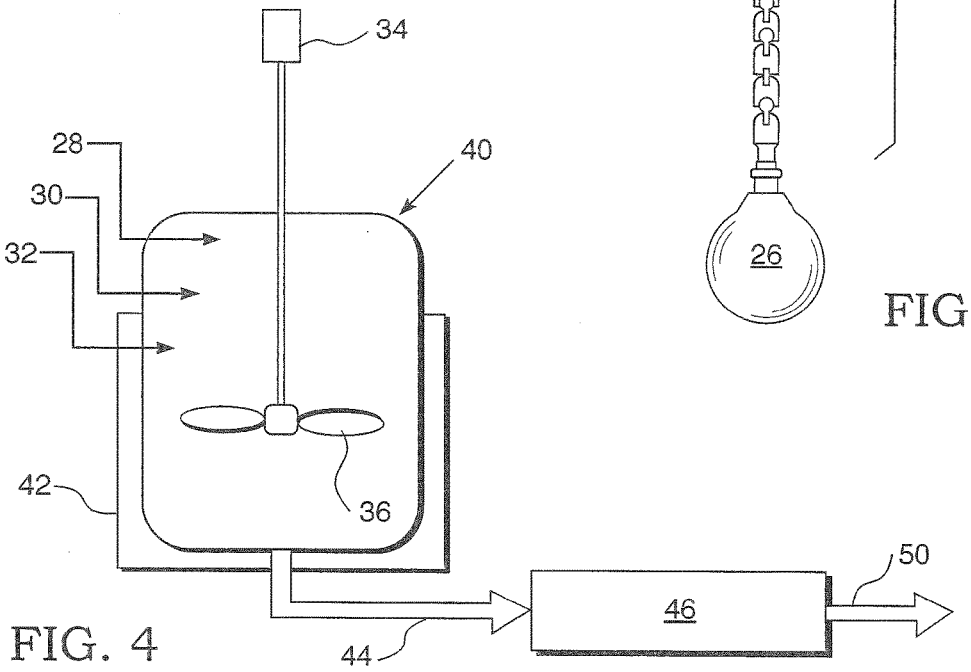
FIG. 4 is a schematic illustration of apparatus employable with the Phase III desulfurization process.

FIG. 4 illustrates a form of apparatus employable with the Phase III portion of the method. Phase III catalytically desulfurizes sulfur-containing fractions by oxidative process and can also be employed to remove nitrogen. Hydrogen peroxide or another oxidant is introduced through port 28 and the solid catalyst which is preferably molybdenum/aluminum catalyst and may be a mixture of molybdenum trioxide and aluminum oxide is introduced through port 30. The heavy fraction from Phase I is introduced through port 32 for the desulfurization and nitrogen removal process. A mixer blade 36 is rotated by motor 34. Temperature in the reactor vessel 40 is controlled by adding hot or cold fluid to jacket 42.

After introduction of the heavy fraction through port 30, a strong oxidizer, such as hydrogen peroxide or other oxidant, is slowly added through port 28 and mixer 36 serves to agitate the material. Mixing is preferably occurring at about 50° C. to 75° C. for about 1.5 to 3 hours. After completion of the reaction, the mixture is pumped or gravity fed through outlet port 44 which can transport solid aqueous and organic material delivering the same to oil/water separator 46 which may advantageously be a centrifugal separator. The processed fraction which will have had sulfur and nitrogen removed emerges from outlet 50, where the liquid layers are separated and the aqueous layer containing most of the spent oxidizer and catalyst are separated from the organic layer for regeneration and reuse.

The catalyst which is preferably a mixture of molybdenum trioxide and aluminum oxide, preferably, is present in an amount of 0.5:1 wt:wt to 1:0.5 wt:wt and, most preferably, a 1:1 wt:wt mixture of the two oxides. The catalyst is added to the reaction vessel 40 with a strong oxidizer which may be approximately 15 percent hydrogen peroxide V/V along with the sulfur and nitrogen containing fraction. The agitator 36 maintains the mixture in suspension at 700 revolutions per minute level or as adequate to create an even mixing of reactants. The mixture is reacted within a mild temperature range of about 50° C. to 75° C. and, preferably, about 55° C. to 65° C. by controlling the heating/cooling jacket 42. After a reaction period of about 1½ to 3 hours and, preferably, about ¾ of an hour to 1¾ hours, the mixture is delivered to the oil/water separator 46 where the liquid layers are separated from the spent oxidizer and catalysts are separated from the organic layer for regeneration and reuse.

Figure 1:
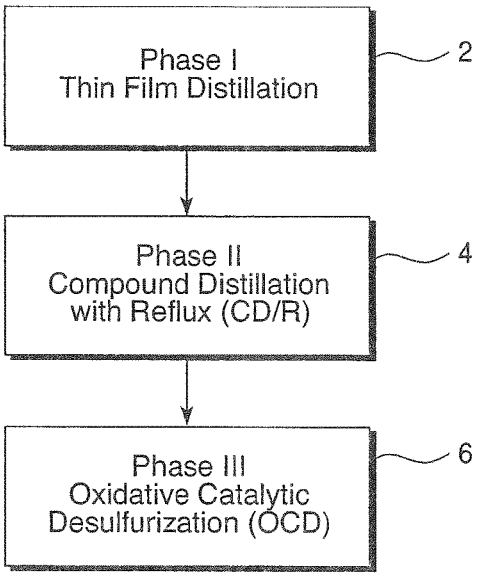
FIG. 1 is a schematic diagram showing an embodiment of the invention employing a three phase process.

It will be appreciated that the three phases disclosed herein may all be employed in the method as illustrated in FIG. 1 and described with respect thereto. Other combinations may be employed advantageously. In each of the variations, Phase I is employed in order to provide appropriate feedstock for further processing. In some instances, Phase II (FIG. 5) or Phase III (FIG. 6), may be employed with Phase I without the use of Phase III in connection with the FIG. 5 embodiment and without the use of Phase II in connection with the FIG. 6 embodiment.

Figure 5:
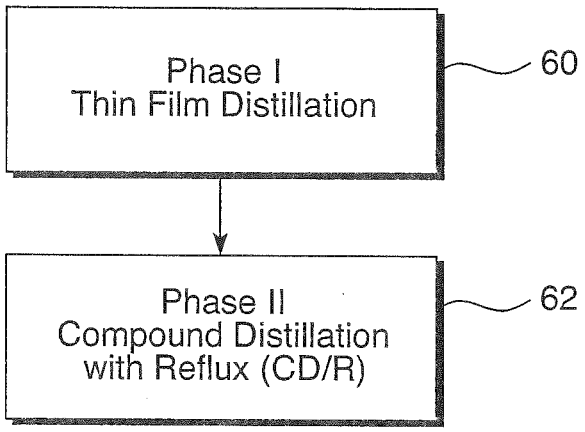
FIG. 5 is a schematic illustration of a method of the invention employing Phases I and II.

In FIG. 5, Phase I, 60 is employed to provide the initial separation and the lighter fraction with contains the valuable product after which the Phase II distillation with reflux 62 is employed to effect the desired further separation and produce the commercial products.

Figure 6:
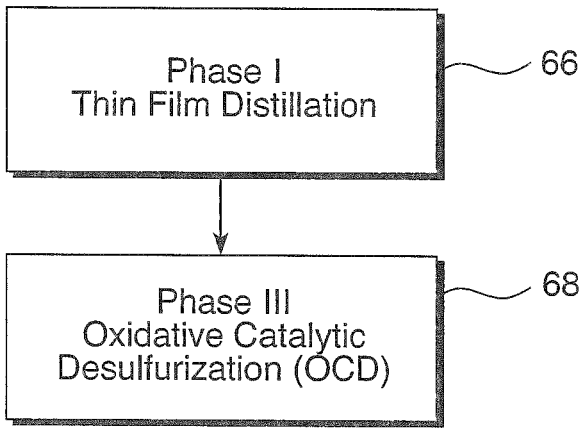
FIG. 6 is a schematic illustration of an embodiment of the invention employing Phases I and III.

In connection with FIG. 6, Phase I is employed with the Phase III, 68 providing oxidative catalytic desulfurization and nitrogen compound removal.

The aluminum/molybdenum catalyst system used with the oxidizing reagent converts organo-sulfur compounds to sulfate converts the organic compounds containing nitrogen to nitrates and removes them from the oil.

Whereas particular embodiments of the invention have been described hereinbefore for purposes of illustration, it will be evident to those skilled in the art that numerous variations of the details may be made without departing from the invention as defined in the appended claims.

What is claimed is:

1. A method of processing pyrolysis oil comprising effecting a first separation of said pyrolysis oil into a lighter fraction and a heavier faction, subjecting said lighter fraction to plate distillation, and subjecting said heavy fraction to sulfur and nitrogen removal.

2. The method of claim 1 including, employing thin film distillation in effecting first said separation.

3. The method of claim 1 including, employing about 10 to 30 plates in said plate distillation.

4. The method of claim 3 including, effecting said plate distillation in a column having a reflux control head.

5. The method of claim 4 including, effecting said plate distillation in stages with a first said stage collecting a lower fraction at about 100 to 400 torr, and a second said stage having a higher vacuum than said first stage.

6. The method of claim 4 including, effecting said plate distillation with said reflux control head set at about a 2:1 to 10:1 ratio.

7. The method of claim 4 including, effecting by said column distillation separation of at least one material selected from the group consisting of terpenes, mercaptans, cyclohexenes and an alkylated monocycle fraction.

8. The method of claim 1 including, effecting said heavy fraction removal of sulfur and nitrogen by catalytic oxidation.

9. The method of claim 8 including, effecting said removal of said sulfur and nitrogen employing a catalyst which is a mixture of aluminum and molybdenum.

10. The method of claim 8 including, said catalyst being a mixture of aluminum oxide and molybdenum trioxide.

11. The method of claim 10 including, the ratio of said molybdenum trioxide to said aluminum oxide being about 0.5:1 to 1:0.5 on a weight to weight basis.

12. The method of claim 1 including, said lighter fraction after plate distillation being treated by catalytic oxidation.

13. The method of claim 12 including said heavy fraction being usable as fuel oil.

14. The method of claim 1 including, said oil with said lighter fraction being about 20 to 35 percent weight of said pyrolysis oil and said heavy fraction being about 65 to 80 weight percent of said pyrolysis oil.

15. The method of claim 12 including, the source of said pyrolysis oil being scrap tires.

16. The method of claim 1 including, said lighter fraction containing at least one material selected from the group consisting of terpenes, mercaptans, and cyclohexenes.

17. A method of processing pyrolysis oil comprising, effecting a first separation of said pyrolysis oil into a lighter fraction and a heavy fraction, and, subjecting said lighter fraction to plate distillation.

18. The method of claim 17 including, employing thin film distillation in effecting said first separation.

19. The method of claim 17 including, employing about 10 to 30 plates in said plate distillation.

20. The method of claim 17 including, said heavy fraction being usable as a fuel oil.

21. The method of claim 17 including employing said oil with the lighter said fraction consisting of about 20 to 35 weight percent of said oil and said heavy fraction being about 65 to 80 weight percent of said pyrolysis oil.

22. The method of claim 17 including, the source of said pyrolysis oil being scrap tires.

23. The method of claim 17 including, said lighter fraction containing at least one material selected from the group consisting of terpenes, mercaptans and cyclohexenes.

24. A method of processing pyrolysis oil comprising, effecting a first separation of said pyrolysis oil into a lighter fraction and a heavy fraction, and subjecting said heavy fraction to catalytic oxidation.

25. The method of claim 24 including, employing thin film distillation in effecting said first separation.

26. The method of claim 25 including, said heavy fraction being usable as a fuel oil.

27. The method of claim 25 including, employing said oil with the lighter said fraction consisting of about 20 to 35 weight percent of said oil and said heavy fraction being about 65 to 80 weight percent of said pyrolysis oil.

28. The method of claim 25 including, the source of said pyrolysis oil being scrap tires.

* * * * *